US007704094B2

(12) United States Patent
Sato et al.

(10) Patent No.: US 7,704,094 B2
(45) Date of Patent: Apr. 27, 2010

(54) CONNECTION STRUCTURE CONNECTING AN LED COMPONENT

(75) Inventors: Masanobu Sato, Toyota (JP); Kenichi Shibata, Toyota (JP); Yoshisada Sano, Toyota (JP); Noritsugu Enomoto, Inukami-gun (JP); Takenobu Yabu, Inukami-gun (JP); Naobumi Kuboki, Inukami-gun (JP); Shigeki Motomura, Inukami-gun (JP); Takehide Ikeda, Inukami-gun (JP)

(73) Assignees: Toyota Boshoku Kabushiki Kaisha, Kariya-shi (JP); The Furukawa Electric Co., Ltd., Tokyo (JP); Furukawa Automotive Systems Inc., Inukami-gun (JP)

( * ) Notice: Subject to any disclaimer, the term of this patent is extended or adjusted under 35 U.S.C. 154(b) by 0 days.

(21) Appl. No.: 12/435,088

(22) Filed: May 4, 2009

(65) Prior Publication Data

US 2009/0291587 A1 Nov. 26, 2009

(30) Foreign Application Priority Data

May 23, 2008 (JP) ..... 2008-135331

(51) Int. Cl.
*H01R 4/24* (2006.01)

(52) U.S. Cl. ..... 439/422; 439/425; 439/426

(58) Field of Classification Search ..... 439/422, 439/425, 426
See application file for complete search history.

(56) References Cited

U.S. PATENT DOCUMENTS 6,261,119 B1 * 7/2001 Green ..... 439/425
7,322,848 B2 * 1/2008 Hatton ..... 439/425
7,399,105 B2 * 7/2008 Southard et al. ..... 439/425

FOREIGN PATENT DOCUMENTS

JP 2004-111435 4/2004

* cited by examiner

*Primary Examiner*—Tho D Ta
(74) *Attorney, Agent, or Firm*—Oblon, Spivak, McClelland, Maier & Neustadt, L.L.P.

(57) ABSTRACT

The present invention has an object of providing a connection structure capable of easily connecting an LED component to a flat cable. An LED unit 1 includes an upper case 7, a pierce terminal 6, a lower case 9 and an intermediate terminal 5. An LED chip 3 is pressed to the pierce terminal 6 by a convexed spring 51 to electrically connect the LED chip 3 to the flat cable 100. Conductors 101 included in the flat cable 100 are formed of phosphor bronze formed of tin (Sn), phosphorus (P), copper (Cu) and unavoidable impurities and having a tensile strength of 480 to 550 MPa, whereas a pierce plate 63 of the pierce terminal 6 piercing through the conductor 101 is formed of a copper alloy, which is a high strength conductive member having a higher strength than that of the conductor 101 and having conductivity.

7 Claims, 11 Drawing Sheets

CONNECTION STRUCTURE CONNECTING AN LED COMPONENT

BACKGROUND OF THE INVENTION

1. Field of the Invention

The present invention relates to a connection structure for connecting an LED component usable for, for example, an illumination device or the like of a vehicle to a flat cable.

2. Description of the Prior Art

Conventionally, an electronic component-mounted module including a plurality of electronic components mounted on a printed board is used for various types of control units, illumination devices, or the like of automobiles. For example, such an electronic component-mounted module includes the electronic components mounted on the board by solder connection, and the electronic component-mounted module is connected to an external electric circuit by a connector having a terminal connected to the board by soldering (see Patent Document 1).

The electronic components and the circuit conductor are connected to each other by soldering. This involves a problem that for connecting an LED component, which is more and more decreasing in size such as an LED chip having a planar size of, for example, 2 mm×2 mm, a great amount of facility investment and highly precise quality control are required.

Patent Document 1: Japanese Laid-Open Patent Publication No. 2004-111435

SUMMARY OF THE INVENTION

The present invention has an object of providing a connection structure capable of easily connecting an LED component to a flat cable.

The present invention is directed to a connection structure, comprising a first case for holding an LED component; a connection terminal for electrically connecting the LED component to an electric cable; a second case located oppositely to the first case with respect to the electric cable and fit with the first case for holding and attaching the electric cable between the second case and the first case; and a terminal member for causing the first case to hold the LED component and connecting the LED component to the connection terminal. The terminal member includes at least one pair of convexed springs; one of the convexed springs is engaged with the first case; the other convexed spring presses the LED component to the connection terminal; the electric cable is formed of a flat cable including a plurality of planar conductors located with a predetermined distance provided therebetween in a width direction and a covering member for integrally covering the plurality of planar conductors provide a planar form; the connection terminal includes a piercing connection part piercing through, and connected to, the planar conductors; and the planar conductors are formed of phosphor bronze formed of tin (Sn), phosphorus (P), copper (Cu) and unavoidable impurities and having a tensile strength of 480 to 550 MPa whereas the piercing connection part is formed of a high strength conductive member having a higher strength than that of the planar conductors and having conductivity.

In one embodiment of the present invention, the LED component and the connection terminal to which the LED component is pressed may be provided between the pair of convexed springs.

In one embodiment of the present invention, the flat cable may include a case engageable part engageable with the first case or the second case.

In one embodiment of the present invention, the second case may be provided with a coming-off prevention means for preventing the piercing connection part piercing through the flat cable from coming off.

In one embodiment of the present invention, the piercing connection part may have a generally rectangular cross-section; the coming-off prevention means may be generally circular with an inner circular hole; and the diameter of the hole of the coming-off prevention means may substantially match the length of the rectangular cross-section of the piercing connection part in a longitudinal direction.

In one embodiment of the present invention, the coming-off prevention means may be formed separately from the second case.

The LED component is a light source device using an LED such as an LED chip or the like.

The plurality of connection terminals electrically connected to the electric cable encompass terminals for directly connecting the LED component to the flat cable, or terminals for connecting the LED component and another electronic component or connecting a plurality of LED components and thus indirectly connecting the LED component to the flat cable.

The piercing connection part encompasses a pierce plate, namely, a pierce blade, and the connection terminals encompass a pierce terminal or the like including a plurality of pierce blades.

The present invention provides a connection structure capable of easily connecting an LED component to a flat cable.

DESCRIPTION OF THE REFERENCE NUMERALS

Figure 1:
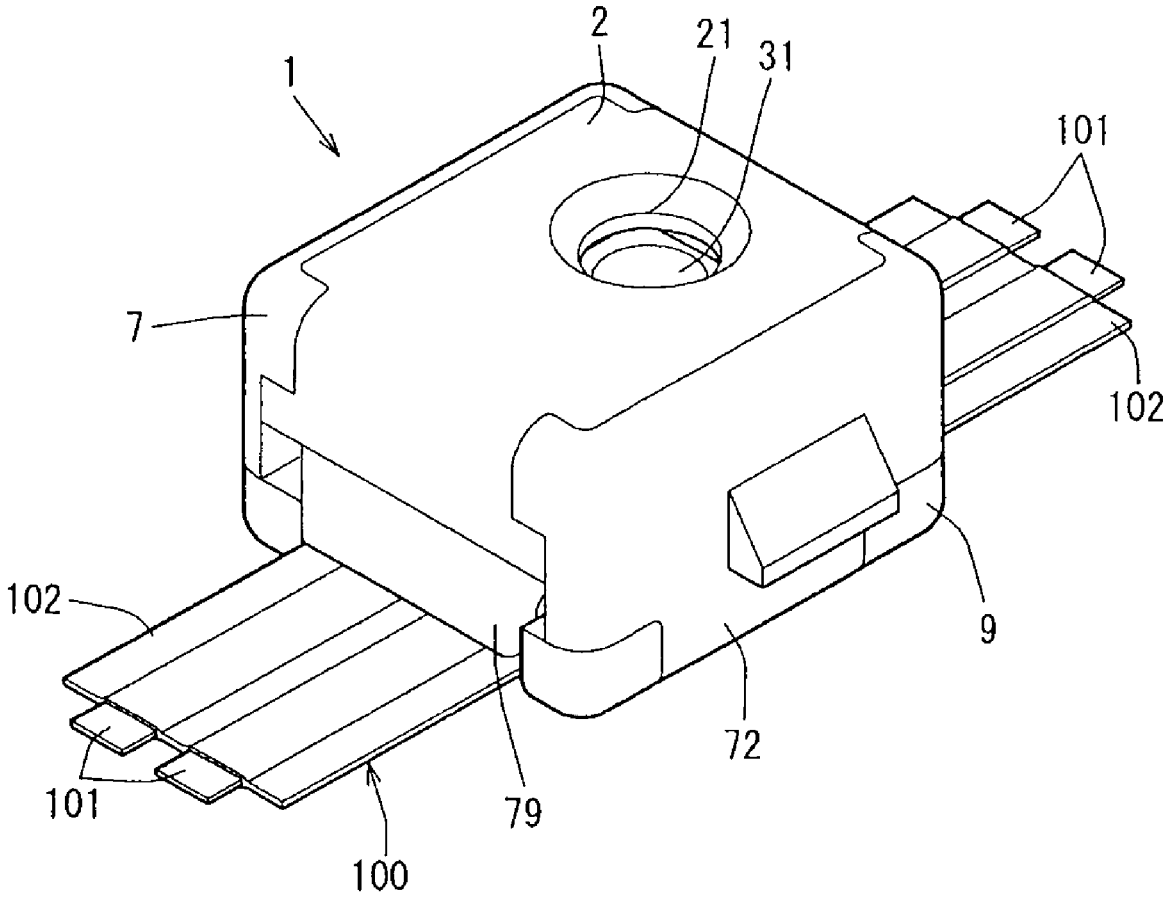
FIG. 1 is an isometric view of an LED unit.

1 LED unit
3 LED chip
5 Intermediate terminal

6 Pierce terminal
6A Pierce terminal for LED
7 Upper case
8 Backup plate
9 Lower case
51*a*, 51*b* Convexed spring
63 Pierce plate
100 Flat cable
101 Conductor
102 Nonconductive laminate sheet
110 Engageable convexed part
d Hole diameter
H Width

DESCRIPTION OF THE PREFERRED EMBODIMENTS

An LED unit according to the present invention includes an upper case 7 for holding an LED chip 3, a pierce terminal 6A for LED for electrically connecting the LED chip 3 to a flat cable 100, and a lower case 9 located oppositely to the upper case 7 with respect to the flat cable 100 and fit with the upper case 7 for holding and attaching the flat cable 100 between the lower case 7 and the upper case 7.

The LED unit 1 further includes an intermediate terminal 5 for causing the upper case 7 to hold the LED chip 3 and connecting the LED chip 3 to the pierce terminal 6A.

The intermediate terminal 5 includes a pair of convexed springs 51. Among the convexed springs 51 (51*a*, 51*b*), one convexed spring 51*a* is engaged with the upper case 7, and the other convexed spring 51*b* presses the LED chip 3 to the pierce terminal 6A.

The LED chip 3 and the pierce terminal 6A to which the LED chip 3 is pressed are located between the pair of convexed springs 51*a* and 51*b*.

The flat cable 100 includes two conductors 101 separated from each other with a predetermined distance provided therebetween in a width direction and a nonconductive laminate sheet 102 for integrally covering the two conductors 101 to provide a planar form. The flat cable 100 is bent to have an engageable convexed part 110 which is engageable with the lower case 9.

The conductors 101 of the flat cable 100 are formed of phosphor bronze formed of tin (Sn), phosphorus (P), copper (Cu) and unavoidable impurities and having a tensile strength of 480 to 550 MPa. Pierce plates 63 described below are formed of a copper alloy, which is a high strength conductive member having a higher strength than that of the conductors 101 formed of the phosphor bronze and having conductivity.

The lower case 9 is provided with backup plates 8 for preventing the pierce plates 63 of pierce terminals 6 piercing through, and connected to, the conductors 101 from coming off.

The pierce plates 63 are formed to have a generally rectangular cross-section, and the backup plates 8 are formed to be generally circular with an inner circular hole, namely, are formed to be donut-shaped. The diameter d of the hole of each backup plate 8 having such a shape is substantially the same as the length of the generally rectangular cross-section of each pierce plate 63, i.e., the width H (see FIG. 11(*d*)). The backup plates 8 are separately formed from the lower case 9.

The above-described structure of the LED unit 1 will be described in more detail with respect to FIG. 1, which is an isometric view of the LED unit 1, and FIG. 2, which is an exploded isometric view of the LED unit 1. The LED unit 1 is a connection unit for connecting the LED chip 3 to the flat cable 100 and also connecting a resistor 4 which is provided for adjusting the voltage to the flat cable 100 at the same time.

The flat cable 100 includes the two strip-like conductors 101 arranged parallel to each other with a prescribed distance provided therebetween in the width direction and the nonconductive laminate sheet 102 for integrally covering the two conductors 101 from top and bottom surfaces of the conductors 101.

The conductors 101 are formed of phosphor bronze formed of tin (Sn), phosphorus (P), copper (Cu) and unavoidable impurities and having a tensile strength of 480 to 550 MPa.

The flat cable 100, which is flexible, is bent to have the engageable convexed part 110 which is convexed as seen from the side, namely, which is stepped up from the remaining part, and has a length corresponding to the length of the lower case 9.

In the figures, the flat cable 100 is partially shown, but the flat cable 100 may be formed to have a necessary length and located at a predetermined position in the vehicle or the like.

Figure 2:
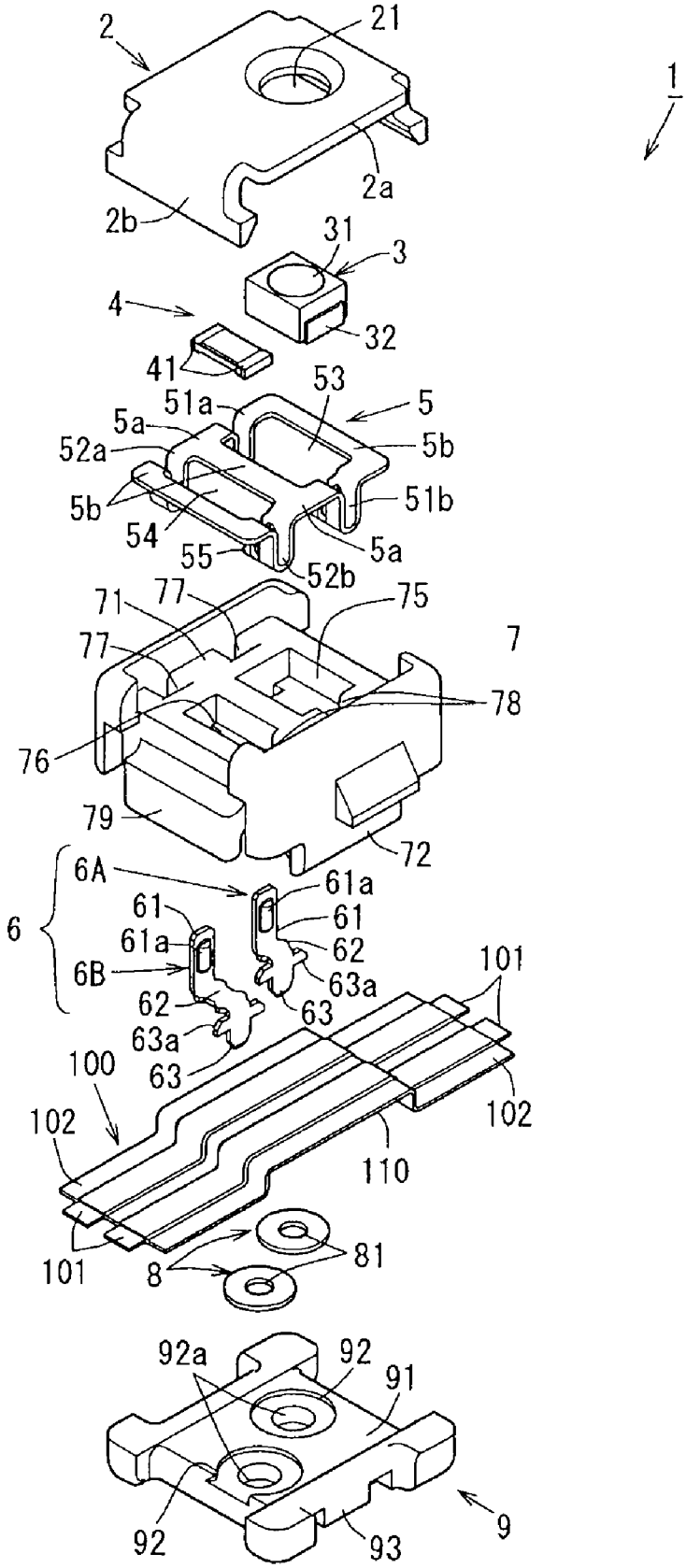
FIG. 2 is an exploded isometric view of the LED unit.

As shown in FIG. 2, the LED unit 1 includes the upper case 7 as a first case, the LED chip 3 and the resistor 4 mounted on the upper case 7, the pierce terminals 6 (6A, 6B) for connecting the LED chip 3 and the resistor 4 to the flat cable 100, the intermediate terminal 5 for fixing the LED chip 3 and the resistor 4, a cover 2 for covering the intermediate terminal 5 from the top, the backup plates 8 for preventing the pierce terminals 6 from coming off, and the lower case 9 as a second case to which the backup plates 8 are attached.

The cover 2 includes a cover main body 2*a* formed of a resin plate and having a rectangular shape longer in a longitudinal direction as seen from the top, and engageable claws 2*b* engageable with top end surfaces of the upper case 7. The engageable claws 2*b* are provided at both ends, of the cover main body 2*a*, in a longitudinal direction of the flat cable 100 (hereinafter, referred to simply as the "longitudinal direction").

The cover 2 is formed to be assembled with the upper case 7 from the top so as to cover, from the top, the LED chip 3, the resistor 4, the intermediate terminal 5, and the pierce terminals 6 assembled in the upper case 7.

The cover main body 2*a* has a circular window 21 at a center thereof in a width direction of the flat cable 100 (hereinafter, referred to simply as the "width direction"). When the cover 2 is assembled with the upper case 7, a light emitting section 31 of the LED chip 3 mounted inside can be visually recognized from outside through the circular window 21.

The LED chip 3 has a generally rectangular parallelepiped shape which is smaller in height than the size in the width direction or the longitudinal direction. The LED chip 3 is square-shaped as seen from the top, with each side being about 1 to 2 mm. The LED chip 3 has the light emitting section 31, which is circular as seen from the top, on a top surface thereof, and L-shaped contact terminals 32 on both side surfaces thereof. The L-shaped contact terminals 32 are continued from a bottom surface of the LED chip 3.

The resistor 4 is formed of a flat plate-like rectangular member. The resistor 4 is greater in width than, generally equal in length to, and about ¼ in height of, the LED chip 3. The resistor 4 has concaved contact terminals 41 on both side surfaces thereof.

The LED chip 3 and the resistor 4 having the above-described structures are arranged in the longitudinal direction. As shown in FIG. 2, the LED chip 3 is located beyond the resistor 4. The contacts 32 are arranged in the width direction, and the contacts 41 are also arranged in the width direction.

The intermediate terminal 5 is formed of one copper plate having an appropriate elasticity. In more detail, the intermediate terminal 5 is formed as follows. The copper plate is pressed to punch out part locating openings 53 and 54, in which the LED chip 3 and the resistor 4 are to be located. As a result, the intermediate terminal 5 has a shape of two squares attached to each other and includes two parallel longitudinal parts 5*a* and three width direction parts 5*b* extended between the longitudinal parts 5*a* with a predetermined distance provided therebetween.

The longitudinal parts 5*a* are pressed downward to be U-shaped, as seen from the side, at middle positions between the width direction parts 5*b*. Such middle positions of the two longitudinal parts 5*a* correspond to each other. As a result, the intermediate terminal 5 is W-shaped as seen from the side.

Bottom portions of the U-shaped parts act as convexed springs 51 (51*a*, 51*b*) and 52 (52*a*, 52*b*).

A part of the convexed spring 51*b* which is to be in contact with the contact terminal 32 of the LED chip 3, and a part of the convexed spring 52*b* which is to be in contact with the contact terminal 41 of the resistor 4, each act as a contact 55. The intermediate terminal 5 may also be formed of a non-metal material which has conductivity.

The pierce terminals 6 each include a contact plate 61 having a contact convexed part 61*a* which is to be in contact with the contact terminal 32 or 41, a horizontal plate part 62 generally perpendicular to the contact plate 61, and a pierce plate 63 generally perpendicular to the horizontal plate part 62 and having convexed parts 63 a projecting in the longitudinal direction at a top end thereof. The contact plate 61, the horizontal plate part 62 and the pierce plate 63 are continuous sequentially from the top, and the pierce terminals 6 are each shaped like a hook.

There are two types of pierce terminals 6, i.e., a pierce terminal 6A for LED which is to be connected with the LED chip 3, and a pierce terminal 6B for resistor which is to be connected with the resistor 4. The horizontal plate part 62 of the pierce terminal 6A for LED is shorter than the horizontal plate part 62 of the pierce terminal 6B for resistor. The contact convexed parts 61*a* are curved to generate an urging force in the width direction.

The pierce terminals 6 are formed of any material which is conductive and has a higher strength than the tensile strength of the conductors 101 of the flat cable 100 which the pierce terminals 6 are to be pierced through and connected with. In this example, the pierce terminals 6 are formed of a copper alloy.

The upper case 7 is formed of a resin rectangular but irregularly-shaped member which is longer in the longitudinal direction than in the width direction as seen from the top. The upper case 7 includes a cover fitting part 71 on both side surfaces in the longitudinal direction and a top surface thereof, to which the cover 2 is to be fit. The upper case 7 also includes engageable claws 72 engageable with the lower case 9. The engageable claws 72 are provided on both side surfaces of the upper case 7 in the width direction; in more detail, at a central bottom end of each side surface. The upper case 7 further includes end projections 79 projecting downward on both end surfaces in the longitudinal direction; in more detail, at a central bottom end of each end surface.

Figure 3:
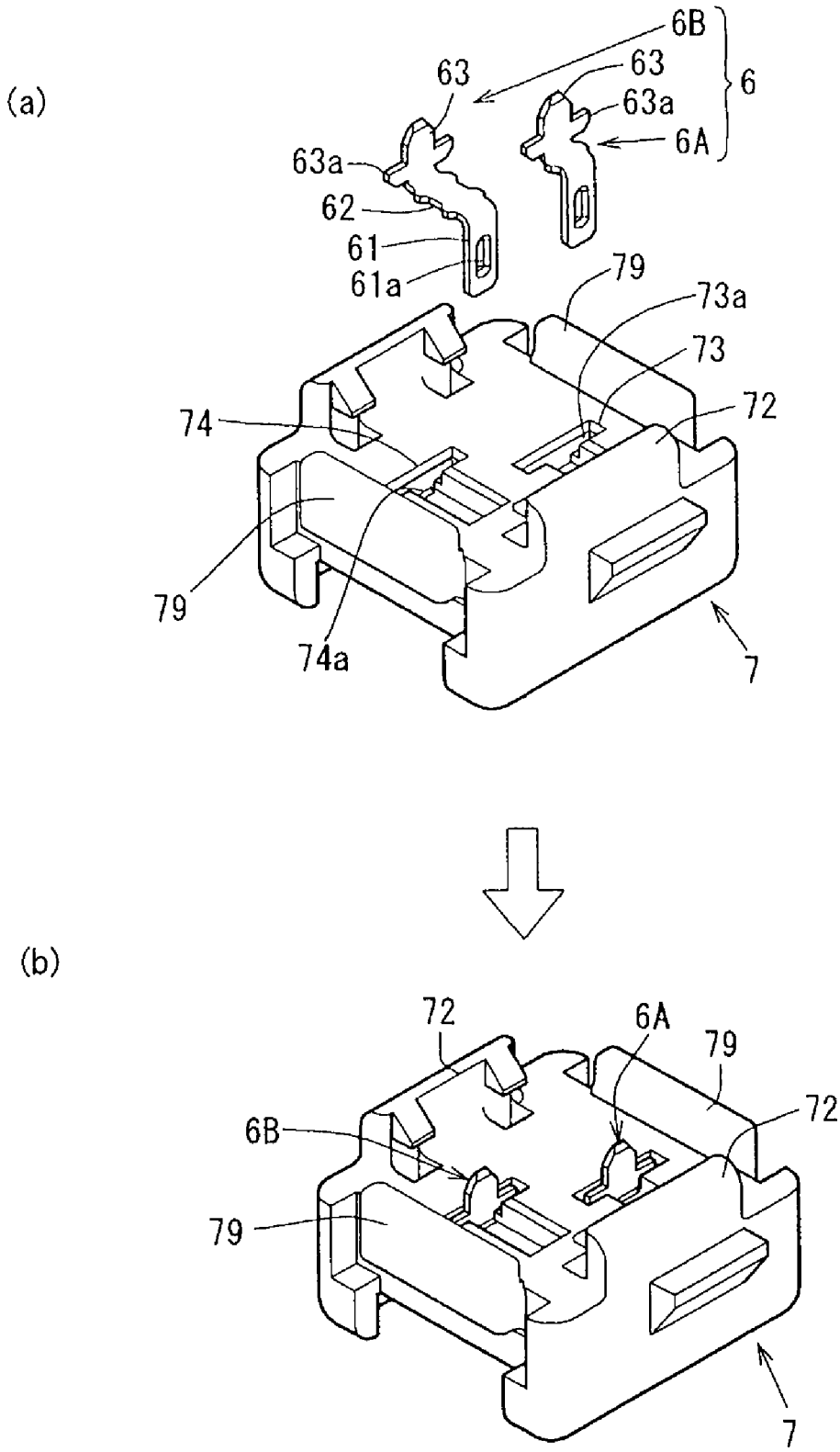
FIG. 3 provides isometric views of an upper case as seen from the bottom side thereof, illustrating how pierce terminals are attached to the upper case.

FIG. 3 provides isometric views of the upper case 7 as seen from the bottom side thereof, illustrating how the pierce terminals 6 are attached to the upper case 7. As shown in FIG. 3, the upper case 7 includes, on a bottom surface thereof, an attaching concaved part 73 for allowing the pierce terminal 6A for LED to be attached to the upper case 7, and an attaching concaved part 74 for allowing the pierce terminal 6B for resistor to be attached to the upper case 7.

The cover fitting part 71 includes a first accommodation part 75 for accommodating the LED chip 3 and a second accommodation part 76 for accommodating the resistor 4. The first accommodation part 75 and the second accommodation part 76 are provided in a top surface of the cover fitting part 71 at a center in the width direction, and are separated with a predetermined distance provided therebetween in the longitudinal direction.

The first accommodation part 75 and the second accommodation part 76 are respectively communicated with through-holes 73*a* and 74*a* formed in the attaching concaved parts 73 and 74 for allowing the contact plates 61 to pass through. The contact plates 61 of the pierce terminals 6 attached to the attaching concaved parts 73 and 74 pass through the through-holes 73*a* and 74*a* and projected into the first accommodation part 75 and the second accommodation parts 76.

On both sides of the first accommodation part 75 and the second accommodation parts 76 in the width direction, insertion concaved parts 77 and 78 are formed for allowing the convexed springs 51 and 52 of the intermediate terminal 5 to be inserted. Into the insertion concaved parts 77 outer to the through-holes 73*a* and 74*a*, the convexed springs 51*a* and 52*a* are to be inserted. The insertion concaved parts 78 facing the insertion concaved parts 77 are communicated with the first accommodation part 75 and the second accommodation part 76. Into the insertion concaved parts 78, the convexed springs 51*b* and 52*b* are to be inserted.

As shown in FIG. 2, the backup plates 8 are each formed of a conductive metal circular donut-shaped plate member. Two backup plates 8 are provided respectively in correspondence with the first pierce terminal 6A and the second pierce terminal 6B.

Figure 11:
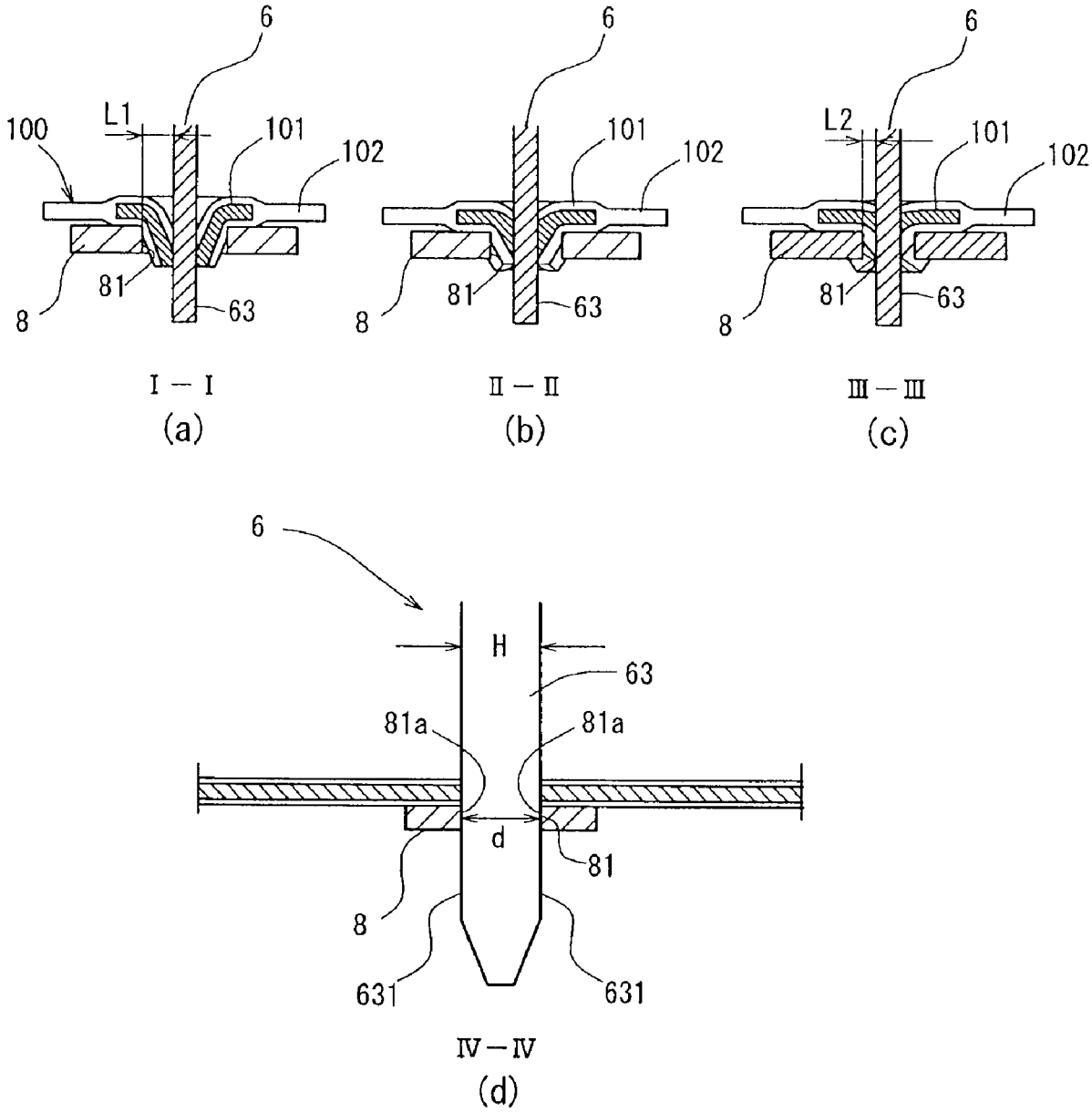
FIG. 11 provides views illustrating the connection structure of the pierce terminals and the backup plates.

The inner diameter d (see FIG. 11(*d*)) of a central engageable hole 81 of each backup plate 8 is set to be substantially the same as the width H (see FIG. 11(*d*)) of the pierce plate 63 of each pierce terminal 6. (The backup plates may also be formed of a non-metal material which has conductivity.)

The lower case 9 is formed of a resin dish-like rectangular member which is longer in the longitudinal direction as seen from the top. The lower case 9 includes a cable fitting part 91 on both side surfaces in the longitudinal direction, i.e., on both end surfaces, and a top surface thereof. The engageable convexed part 110 of the flat cable 100 is to be fit with the cable fitting part 91.

The cable fitting part 91 has position defining parts 92 formed in a top surface of the inner part thereof for defining the positions of the backup plates 8. Case stopping parts 93 are provided on both side surfaces of the case fitting part 91, in more detail, in the vicinity of a center of each side surface. The case stopping parts 93 allow the engageable claws 72 of the upper case 7 to be engaged therewith to engage and fix the upper case 7.

The position defining parts 92 each have an interference prevention concaved part 92*a* at a center as seen from the top for preventing interference with the pierce plate 63 passing through the engageable hole 81 of the backup plate 8.

Where the width-direction positions of the contact plates 61 are the same, the width-direction positions of the pierce plates 63 projecting downward are different due to the difference in the length of the horizontal plates 62 of the pierce terminals 6 attached to the attaching concaved parts 73 and 74 of the upper case 7. This arrangement is provided in positional alignment with the conductors 101 through which the pierce plates 63 are pierced. The position defining parts 72 of the lower case 9 are formed such that the backup plates 8 are located at the positions where the pierce plates 63 pierce through the conductors 101.

By using the LED unit 1 having the above-described structure to electrically connect the flat cable 100 including the conductors 101 having the tensile strength of 480 to 500 MPa, stable electric connection can be realized.

In more detail, the pierce plates 63 of the pierce terminals 6 are allowed to pierce through the conductors 101 covered with the nonconductive laminate sheet 102 to electrically connect the pierce terminals 6 and the flat cable 100 with each other. At this point, the conductors 101 through which the pierce plates 63 are pierced have a strength of 480 MPa or greater. This guarantees the stable electric connection even where a load such as an external force or the like is generated at the position where the pierce plates 63 pierce through the conductors 101.

In the case where, for example, each pierce terminal 6 includes one pierce plate 63, the following occurs. In the state where the pierce plate 63 is pierced through a conventional pure copper conductor, the connection part of the pierce terminal 6 and the conductor 101 is supplied with an external force in the same direction as the piercing direction. In this case, the contact resistance is increased by 0.3 milliohms and thus the electric connection is lowered.

By contrast, in the case of the conductor 101 formed of phosphor bronze having a tensile strength of 480 MPa or greater, even where the connection part of the pierce terminal 6 and the conductor 101 is supplied with an external force in the same condition as described above, the increase of the contact resistance is suppressed to 0.05 milliohms.

The contact resistance is increased because the connection part of the conductor 101 and the pierce plate 63 piercing through the conductor 101 is deteriorated by the supplied external force. Where the conductor 101 having a tensile strength of 480 MPa or greater is used, the degree of deterioration can be suppressed as compared with the case where the conventional pure copper conductor is used.

The increase of the contact resistance caused by the external force, i.e., 0.05 milliohms, is of a level which does not cause any problem for electric connection. This is why by using the LED unit 1 having the above-described structure to electrically connect the flat cable 100 including the conductors 101 having the tensile strength of 480 MPa or greater, stable electric connection can be maintained.

It is considered that as the tensile strength of the conductors 101 is higher, the electric connection between the pierce terminals 6 and the conductors 101 is more stable. However, when the tensile strength of the conductors 101 is excessively high, there is a risk that the pierce plates 63 may be broken when piercing through the conductors 101. Hence, the upper limit of the tensile strength is set to 550 MPa, and the pierce terminals 6 are formed of a copper alloy having a higher strength than that of the conductors 101. In this manner, the stable electric connection is secured with certainty.

Such an effect provided by the above-described structure is especially conspicuous where each pierce terminal 6 includes one pierce plate 63. Therefore, this structure is suitable to the LED unit 1 which is desired to be more compact.

The conductors 101 of the flat cable 100 are formed of phosphor bronze which is highly strong. Therefore, the connection state can be maintained even without providing the lower case 9 with the backup plates 8 for preventing the pierce plates 63 piercing through the flat cable 101 from coming off. However, by providing the lower case 9 with the backup plates 8 so that the pierce plates 63 pass through the center of the engageable holes 81 of the respective backup plates 8 as in this example, the connection state of the LED unit 1 can be more stabilized.

Now, a method for assembling the LED unit 1 and attaching the flat cable 100 will be described.

A connection method of the LED unit 1 according to the present invention for connecting the LED chip 3 to the flat cable 100 includes a terminal assembling step, an intermediate terminal assembling step, an upper case non-temporary assembling step, a backup plate assembling step, an engageable convexed part forming step, an engaging step, and a case fitting step.

In the terminal assembling step, the pierce terminals 6 for electrically connecting the LED chip 3 and the resistor 4 to the flat cable 100 are temporarily assembled to the upper case 7 for holding the LED chip 3 and the resistor 4.

In the intermediate terminal assembling step, the intermediate terminal 5 is temporarily assembled to upper case 7 having the pierce terminals 6 temporarily assembled thereto.

In the upper case non-temporary assembling step, the LED chip 3 and the resistor 4 are assembled to the upper case 7 having the intermediate terminal 5 and the pierce terminals 6 temporarily assembled thereto, thus to assemble the LED chip 3, the resistor 4 and the pierce terminals 6 to the upper case 7 non-temporarily.

In the backup plate assembling step, the backup plates 8 for preventing the pierce plates 63 piercing through the flat cable 100 from coming off are temporarily assembled to the lower case 9 as the second case.

In the engageable convexed part forming step, the flat cable 100 is bent to form the engageable convexed part 110 which is to be engaged with the lower case 9.

In the engaging step, the engageable convexed part 110 is engaged with the lower case 9.

In the case fitting step, the upper case 7 and the lower case 9 are fit together in the state where the flat cable 100 is held therebetween.

Hereinafter, each step will be described in more detail with reference to the figures.

FIG. 3 illustrates the terminal assembling step. As shown in FIG. 3(*a*), the upper case 7 is put upside down so that the bottom surface is directed upward. The pierce terminal 6A for LED is attached to the attaching concaved part 73 such that the contact plate 61 of the pierce terminal 6A for LED is inserted into the through-hole 73*a*. The pierce terminal 6B for resistor is attached to the attaching concaved part 74 such that the contact plate 61 of the pierce terminal 6B for resistor is inserted into the through-hole 74*a*.

Thus, the pierce terminal 6A for LED and the pierce terminal 6B for resistor can be attached to the upper case 7 in the state where the pierce plates 63 of the pierce terminal 6A for LED and the pierce terminal 6B for resistor project downward from the bottom surface of the upper case 7 at positions shifted in the width direction and the longitudinal direction.

Figure 4:
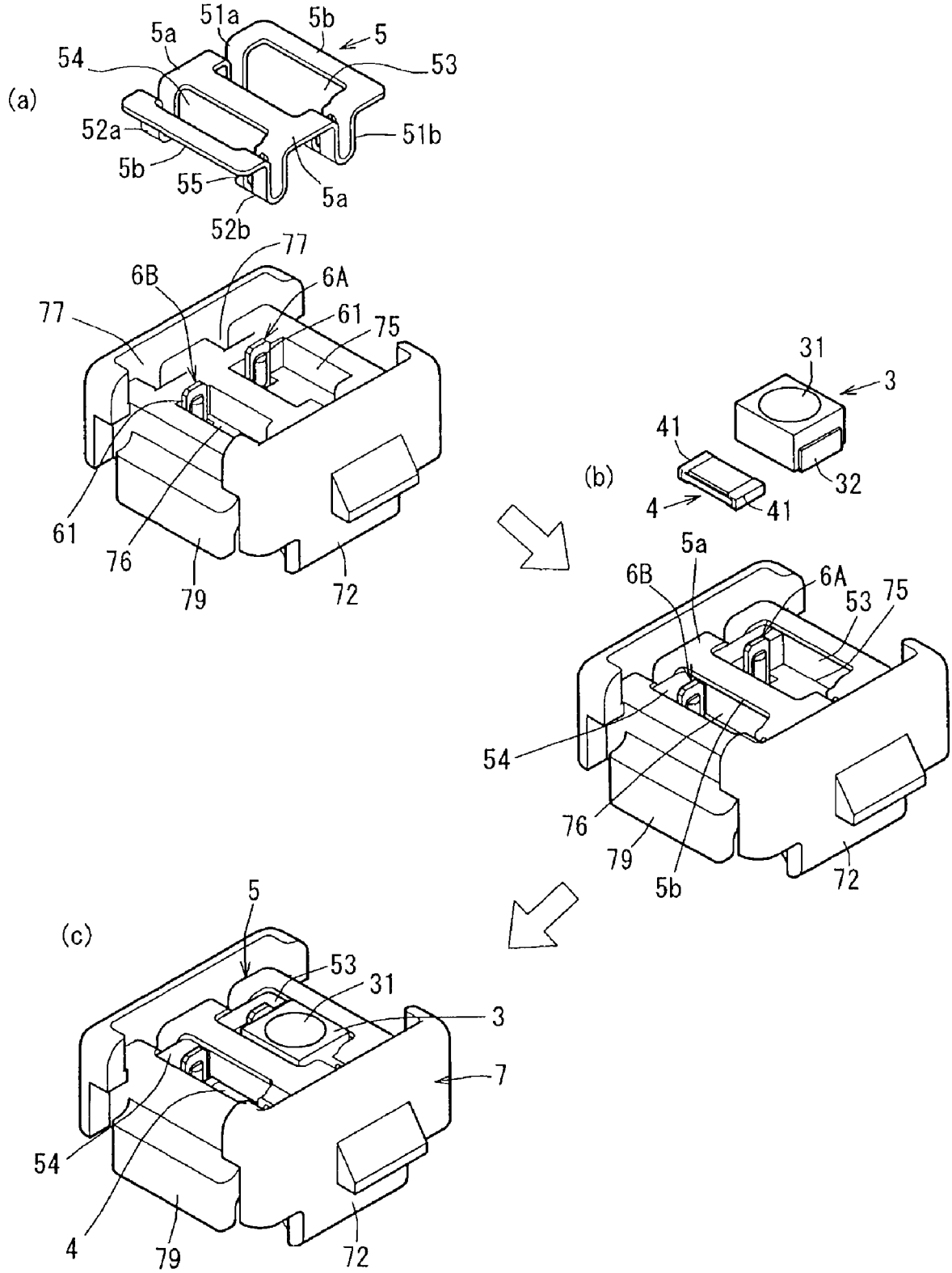
FIG. 4 provides isometric views of the upper case as seen from the top side thereof, illustrating an intermediate terminal assembling step and an upper case non-temporary assembling step.

FIG. 4 provides isometric views of the upper case 7 illustrating the intermediate terminal assembling step and the upper case non-temporary assembling step. As shown in FIG. 4(*a*), the upper case 7 is returned to the state where the top surface is directed upward. In this state, the contact plates 61 of the pierce terminals 6 project from a bottom surface of the first accommodation part 75 and the second accommodation part 76 through the through-holes 73*a* and 74*a*.

In this state, the convexed springs 51*a* and 52*a* are inserted into the insertion concaved parts 77 and the convexed springs 51*b* and 52*b* are inserted into the insertion concaved parts 78 from above the upper case 7. As a result, the intermediate terminal 5 is attached to the upper case 7. At this point, the part locating opening 53 of the intermediate terminal 5 and the first accommodation part 75, and the part locating opening 54 of the intermediate terminal 5 and the second accommodation part 76, positionally correspond to each other in the up-down direction.

As shown in FIG. 4(*b*), the LED chip 3 and the resistor 4 are inserted through the part locating openings 53 and 54 from above the upper case 7, and as shown in FIG. 4(*c*), are accommodated in the first accommodation part 75 and the second accommodation part 76.

Figure 5:
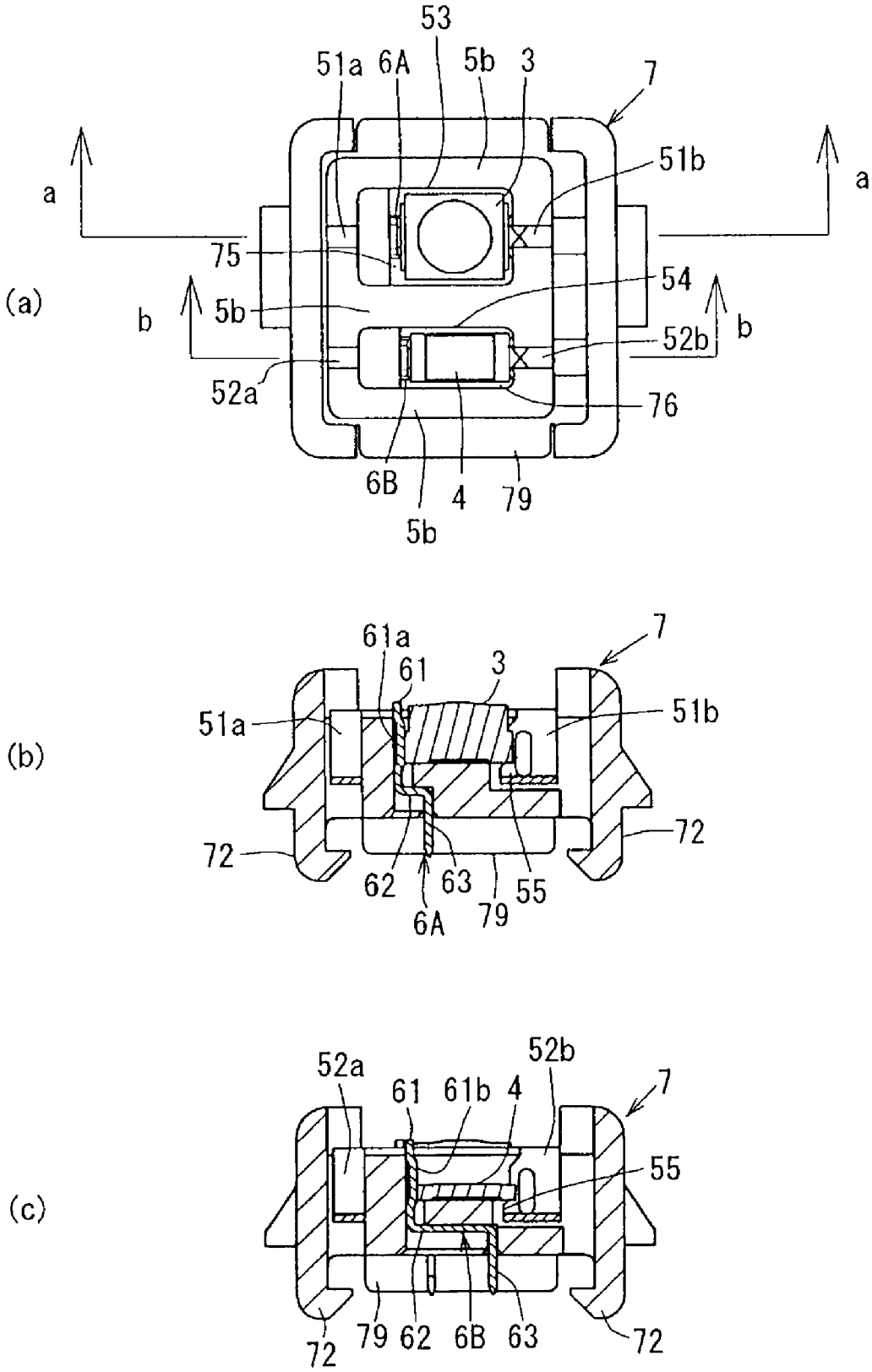
FIG. 5 provides a plan view and cross-sectional views of the upper case after the upper case non-temporary assembling step.

FIG. 5(*a*) is a plan view showing this state, and FIG. 5(*b*) is a cross-sectional view taken along line a-a of FIG. 5(*a*). As shown in FIGS. 5(*a*) and 5(*b*), in the first accommodation part 75, the contact plate 61 of the pierce terminal 6*a* for LED, the LED chip 3, and the contact 55 of the convexed spring 51*b* inserted into the insertion concaved part 78 are located in this order. The convexed spring 51*b* presses the LED chip 3 toward the contact plate 61 via the contact 55. Therefore, the contact terminal 32 of the LED chip 3 on the side of the contact plate 61 is in contact with the contact convexed part 61*a* of the contact plate 61, and the contact terminal 32 on the opposite side is in contact with the contact 55 of the convexed spring 51*b*.

FIG. 5(*c*) is a cross-sectional view taken along line b-b of FIG. 5(*a*). As shown in FIG. 5(*c*), in the second accommodation part 76, the contact plate 61 of the pierce terminal 6B for resistor, the resistor 4, and the contact 55 of the convexed spring 52*b* inserted into the insertion concaved part 78 are located in this order. The convexed spring 52*b* presses the resistor 4 toward the contact plate 61 via the contact 55. Therefore, the contact terminal 41 of the resistor 4 on the side of the contact plate 61 is in contact with the contact convexed part 61*a* of the contact plate 61, and the contact terminal 41 on the opposite side is in contact with the contact 55 of the convexed spring 52*b*.

The intermediate terminal 5 electrically connected to the LED chip 3 and the resistor 4 via the contacts 55 is formed of a copper plate, which is a conductive member. Therefore, an electric circuit of the pierce terminal 6A for LED→the LED chip 3→the intermediate terminal 5→the resistor 4→the pierce terminal 6B for resistor is formed.

Since the convexed springs 51*a* and 52*b* are inserted into the insertion concaved parts 77, the relative position of the intermediate terminal 5 with respect to the upper case 7 is fixed. The pierce terminals 6 are attached to the attaching concaved parts 73 and 74 formed in the bottom surface of the upper case 7 and the contact plates 61 pass through the through-holes 73*a* and 74*a*. Thus, the positions of the pierce terminals 6 with respect to the upper case 7 are also fixed.

The LED chip 3 and the resistor 4 are held in the state of being urged by the pierce terminals 6 and the intermediate terminal 5, the relative positions of which are fixed with respect to the upper case 7, and thus are positionally fixed with respect to the upper case 7. In this manner, the intermediate terminal 5 acts as a fixing tool for the LED chip 3 and the resistor 4 and also as a circuit component.

Figure 6:
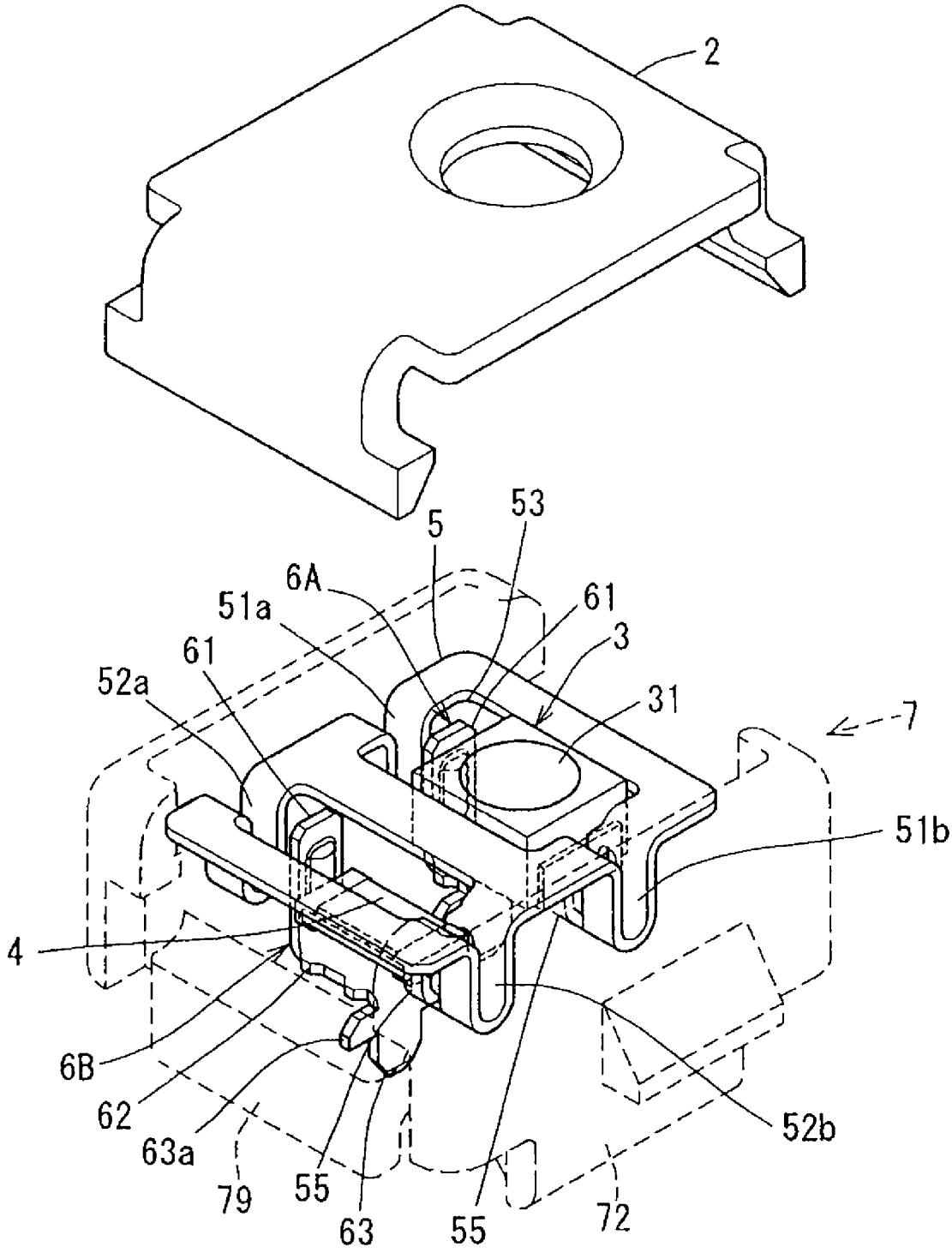
FIG. 6 is an isometric view illustrating the inside of the upper case after the upper case non-temporary assembling step as seen through the upper case.

FIG. 6 is an isometric view of the inside of the upper case 7 after the upper case non-temporary assembling step as seen through the upper case 7. As shown in FIG. 6, the LED chip 3 and the resistor 4 are held in the state of being urged by the convexed springs 51*a* and 52*a* of the intermediate terminal 5 and the contact plates 61 of the pierce terminal 6A for LED and the pierce terminal 6B for resistor and thus are fixed. Therefore, the LED chip 3 and the resistor 4 are fixed in a suspended state with respect to the upper case 7.

In this state, the cover 2 is attached from above the upper case 7 in which the LED chip 3, the resistor 4, the intermediate terminal 5 and the pierce terminals 6 are incorporated.

Figure 7:
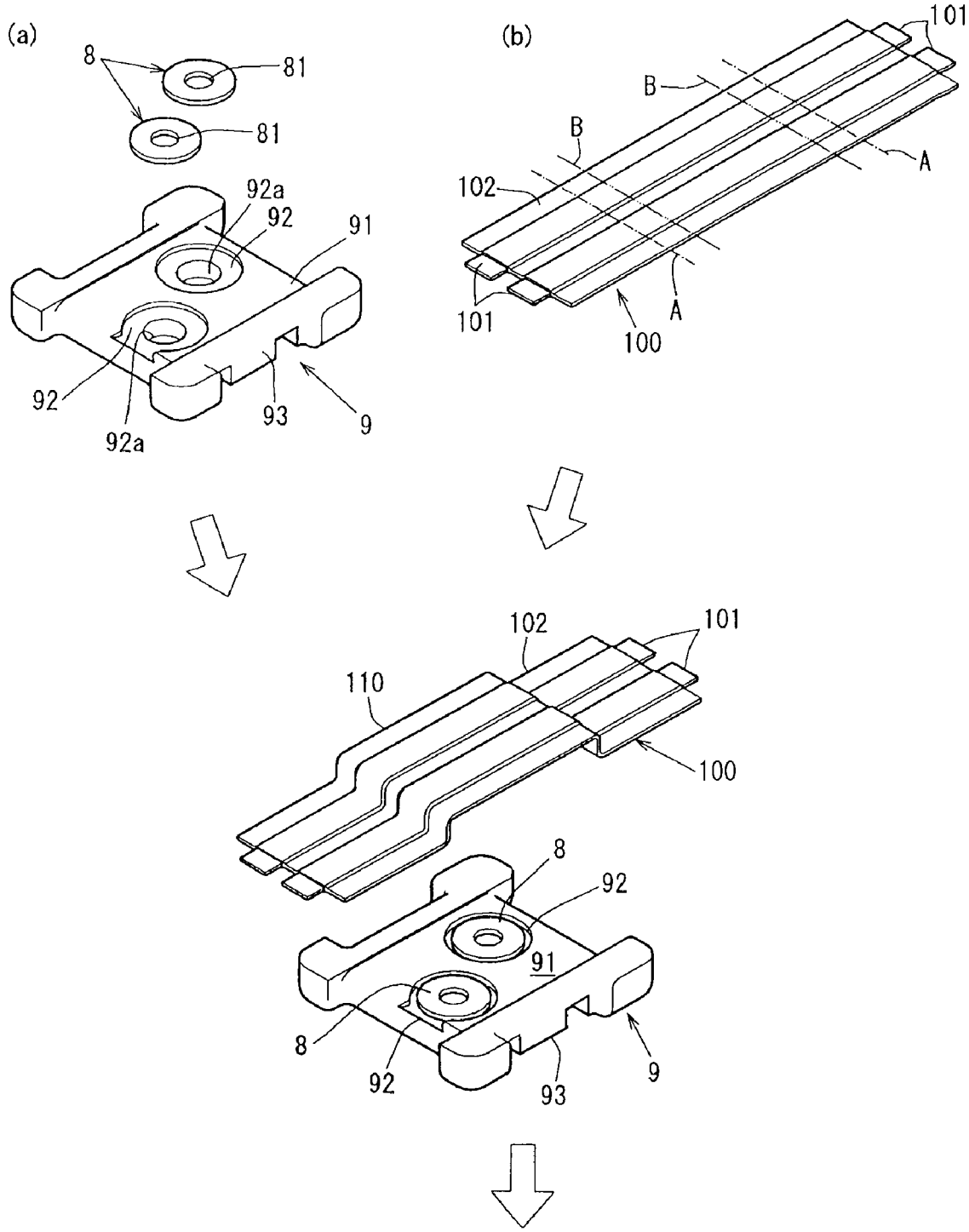
FIG. 7 provides views illustrating a backup plate assembling step, an engageable convexed part forming step, an engaging step, and a case fitting step.

Now, with reference to FIGS. 7 and 8, the backup plate assembling step, the engageable convexed part forming step, the engaging step and the case fitting step will be described. FIG. 7(*a*) shows the backup plate assembling step. As shown in FIG. 7(*a*), the backup plates 8 are attached to the position defining parts 92 from above the lower case 9. At this point, the engageable hole 81 of each backup plate 8 attached to the corresponding position defining part 92 and the interference prevention concaved part 92*a* of the position defining part 92 positionally match each other.

FIG. 7(*b*) shows the engageable convexed part forming step. As shown in FIG. 7(*b*), the flat cable 100 is valley-folded along lines A and mountain-folded along lines B to form the engageable convexed part 110 which is convexed as seen from the side. The distance between the valley-folding line A and the mounding-folding line B is substantially the same as the height of the inner part of the cable fitting part 91 of the lower case 9. The distance between the mounding-folding lines B is substantially the same as the length of the inner part of the cable fitting part 91.

Figure 8:
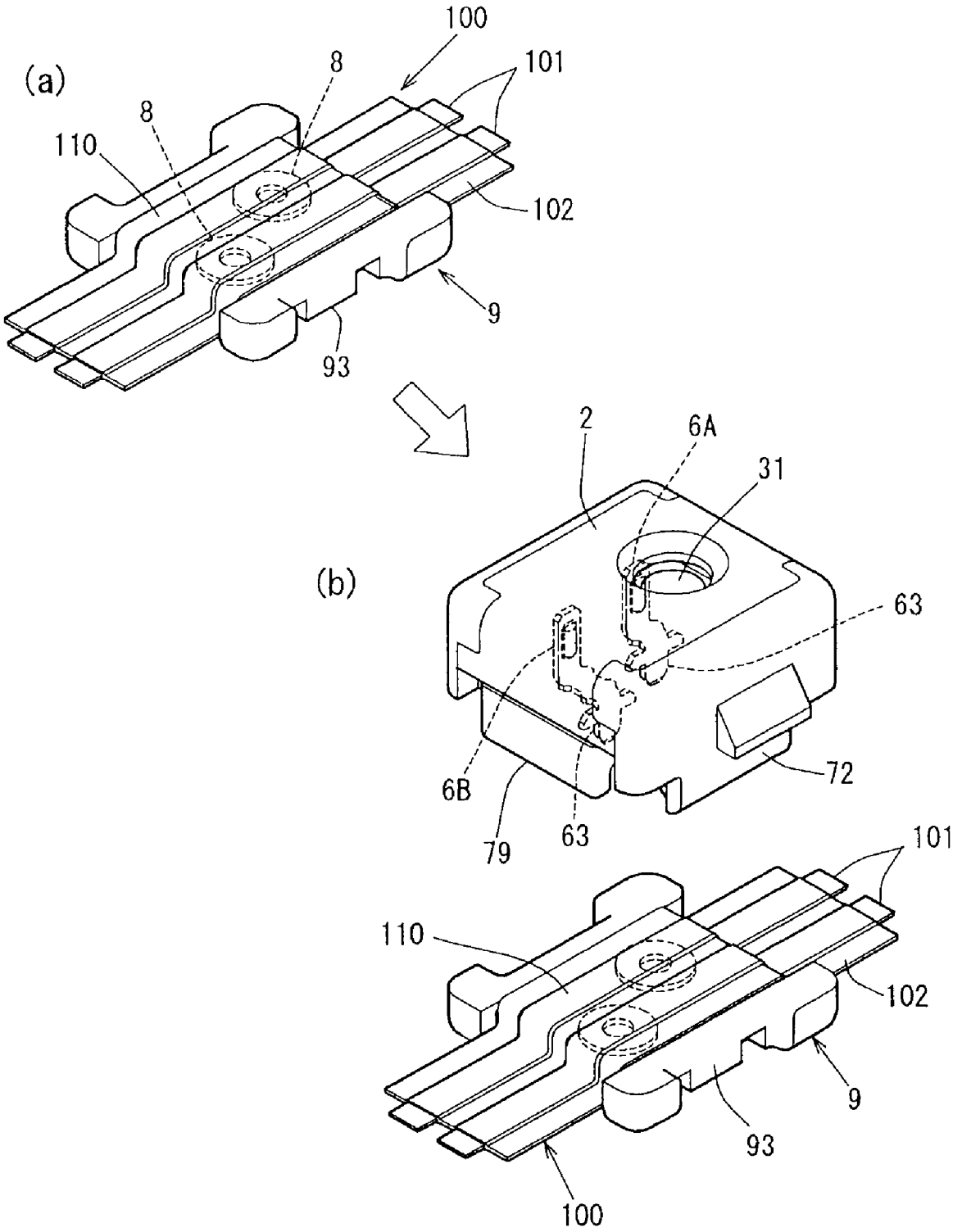
FIG. 8 provides views illustrating the backup plate assembling step, the engageable convexed part forming step, the engaging step, and the case fitting step.

FIG. 8(*a*) shows the engaging step. As shown in FIG. 8(*a*), the engageable convexed part 110 is engaged with the lower case 9 such that the engageable convexed part 110 covers the cable fitting part 91 from above the lower case 9 having the backup plates 8 attached to the position defining parts 92.

FIG. 8(*b*) shows the case fitting step. As shown in FIG. 8(*b*), in the state obtained by the engaging step, the engageable claws 72 of the upper case 7 are engaged with the case stopping parts 93 of the lower case 9 engaged with the engageable convexed part 110 to fit the upper case 7 and the lower case 9. As a result of the upper case non-temporary assembling step, the upper case 7 has the cover 2, the LED chip 3, the resistor 4, the intermediate terminal 5 and the pierce terminals 6 incorporated therein, and the pierce plates 63 are projected from the bottom surface thereof.

At this point, the engageable convexed part 110 of the flat cable 100 is held between the side surfaces in the longitudinal direction, i.e., the end surfaces, and the top surface of the cable fitting part 91 of the lower case 9, and the bottom surface of the upper case 7 and the inner surfaces of the end projections 79 of the upper case 7.

Figure 9:
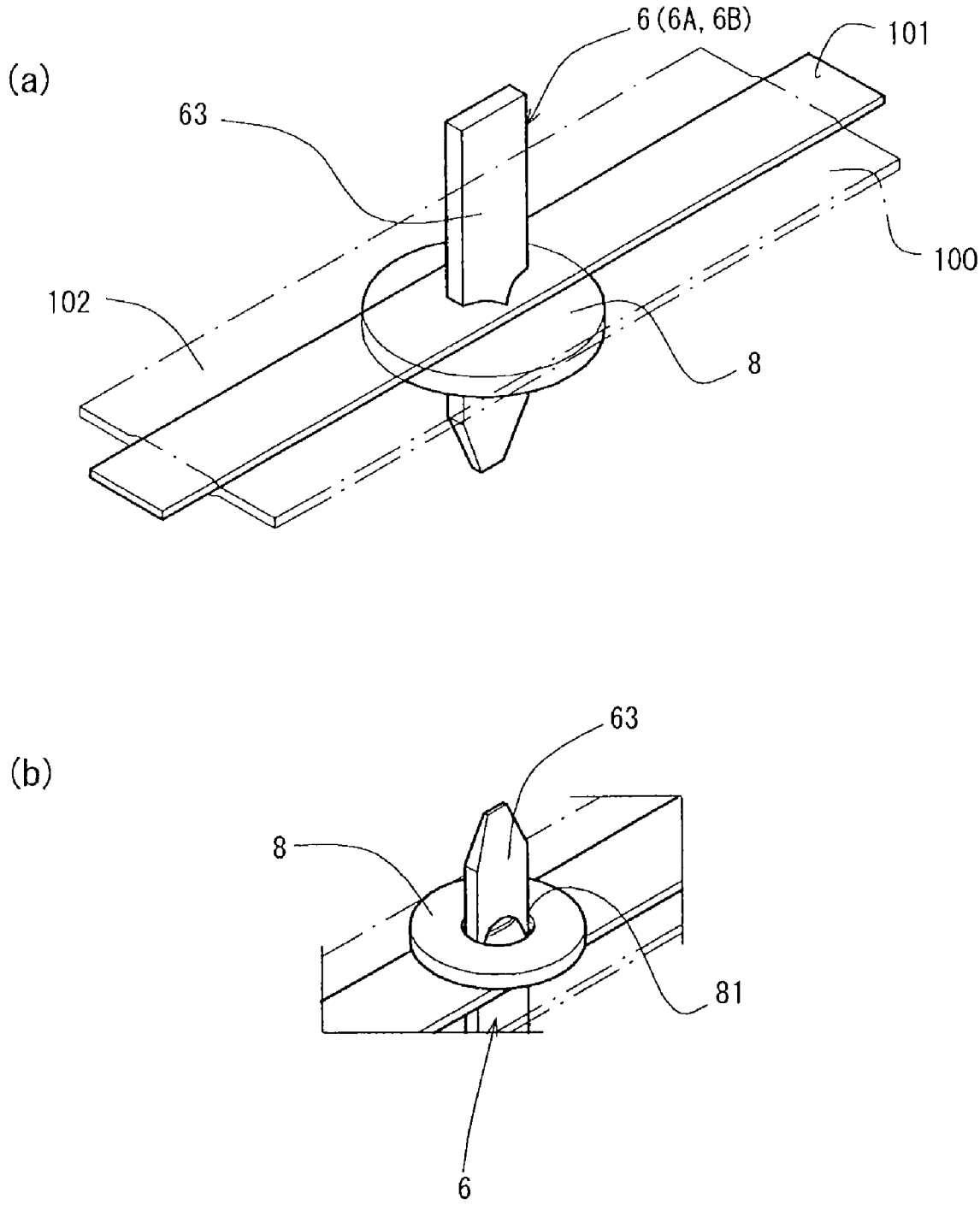
FIG. 9 provides views illustrating a connection structure of pierce terminals and backup plates.
Figure 10:
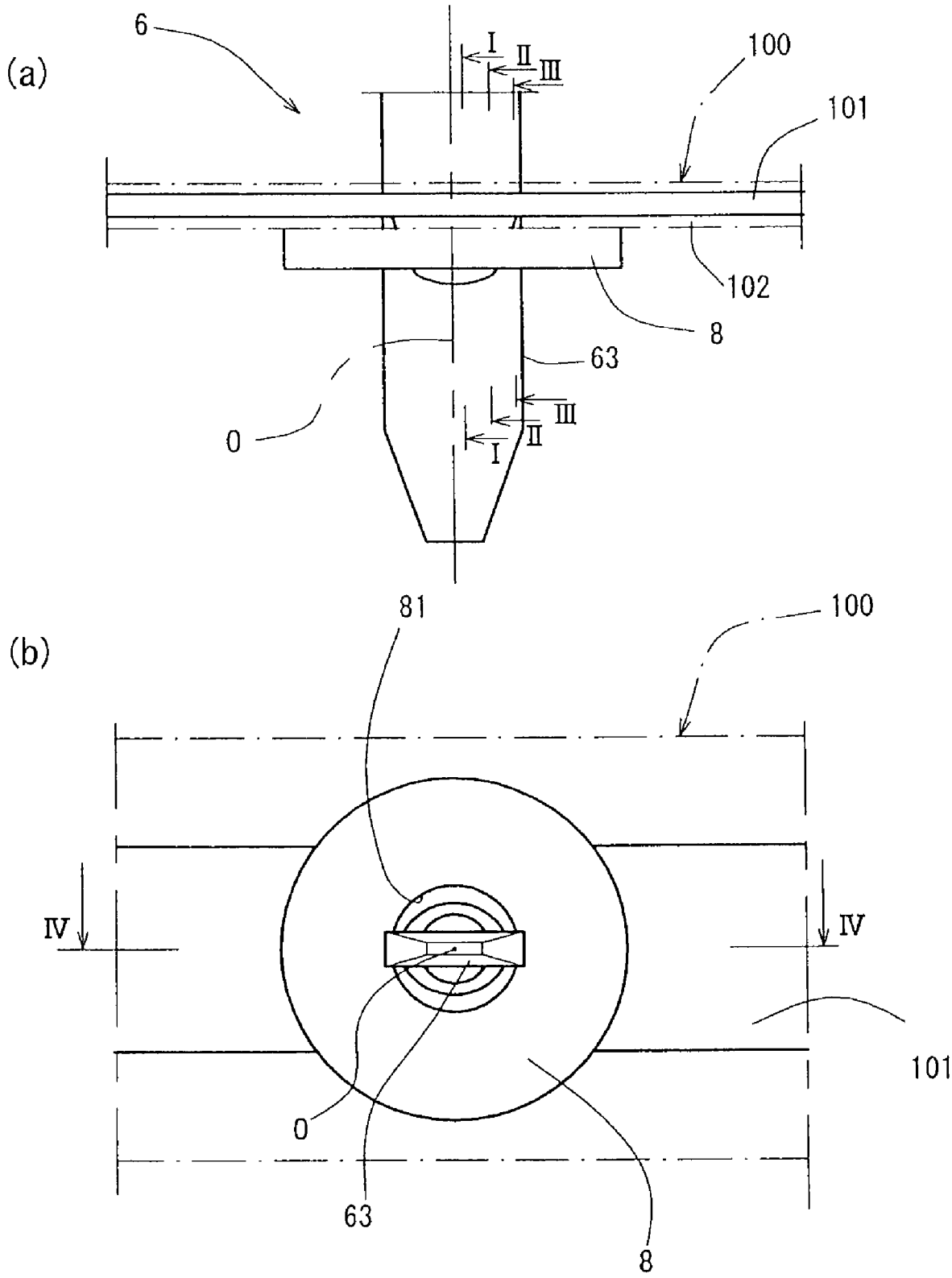
FIG. 10 provides views illustrating the connection structure of the pierce terminals and the backup plates.

Since the upper case 7 and the lower case 9 fit each other, the pierce terminals 6 and the conductors 101 of the flat cable 100 can be connected to each other. This will be described in detail with reference to FIG. 9 through FIG. 11. FIG. 9 through FIG. 11 are provided to explain a connection structure of the pierce terminals 6 and the backup plates 8.

FIG. 9(*a*) is an isometric view as seen from the top side showing a state where the pierce plate 63 of the pierce terminal 6 pierces through, and is fixed to, the flat cable 100. FIG. 9(*b*) is an isometric view as seen from the bottom side showing the state where the pierce plate 63 of the pierce terminal 6 pierces through, and is fixed to, the flat cable 100. FIG. 10(*a*) is a side view, and FIG. 10(*b*) is a bottom view, of the state where the pierce plate 63 pierces through, and is fixed to, the flat cable 100. FIG. 11(*a*) is a cross-sectional view taken along line I-I of FIG. 10(*a*), FIG. 11(*b*) is a cross-sectional view taken along line II-II of FIG. 10(*a*), and FIG. 11(*c*) is a cross-sectional view taken along line III-III of FIG. 10(*a*). FIG. 11(*d*) is a cross-sectional view taken along line IV-IV of FIG. 10(*b*).

As shown in FIG. 9, the pierce plate 63 of the pierce terminal 6 (6A, 6B) pierces through the conductor 101 of the flat cable 100 and is inserted and fit into the engageable hole 81 of the backup plate 8 located on a rear surface of the conductor 101. Thus, the pierce plate 63 is fixed in the piercing-through state.

This piercing-through state is obtained by putting the pierce plate 63 of the pierce terminal 6 downward to insert the bottom end of the pierce plate 63 into the conductor 101.

Since the pierce plate 63 is formed of a copper alloy having a higher strength than that of the conductor 101 having the tensile strength of 480 to 550 MPa, such a piercing-through state can be easily obtained.

Unless the backup plate 8 is set at an appropriate position, the piercing-through state cannot be obtained with certainty due to the malleability of the conductor 101. The backup plate 8 is set at an appropriate position by being attached to the position defining part 92 (FIG. 2) of the lower case 9.

By setting the backup plate 8 at an appropriate position, the clearance (distance) between the engageable hole 81 of the backup plate 8 and the pierce plate 63 of the pierce terminal 6 can be appropriately set and thus a shearing force can be acted on the conductor 101. As a result, the pierce plate 63 of the pierce terminal 6 can be allowed to pierce through the conductor 101 appropriately.

The backup plate 8 moves freely within the range of the position defining part 92. Therefore, when the pierce terminal 6 is inserted from above, the position of the axis of the backup plate 8 is automatically adjusted. Therefore, the pierce terminal 6 can pierce through the conductor 101 of the flat cable 100 in the state where the center of the pierce terminal 6 matches the center of the backup plate 8 with certainty.

Specifically, the pierce terminal 6 is inserted and fixed in the state shown in FIGS. 10 and 11.

As shown in FIG. 11(*a*), which is a cross-sectional view taken along line I-I of FIG. 10(*a*), at the position close to the center O of the pierce terminal 6, the conductor 101 is bent downward largely. Such a deformed state is obtained because a large clearance L1 is obtained from the pierce terminal 6 to the backup plate 8. Since the conductor 101 is deformed in this manner, the pressure to connect the conductor 101 to the pierce terminal 6 is provided.

As shown in FIG. 11(*b*), which is a cross-sectional view taken along line II-II of FIG. 10(*a*), at a position slightly far from the center O of the pierce terminal 6, the conductor 101 is not bent largely, and the backup plate 8 is close to the pierce terminal 6. Therefore, the pressure to connect the conductor 101 to the pierce terminal 6 can be increased. As a result, an electric current to the pierce terminal 6 can be appropriately flown in this area.

As shown in FIG. 11(*c*), which is a cross-sectional view taken along line III-III of FIG. 10(*a*), at a side end of the pierce terminal 6 farther from the center O of the pierce terminal 6, a small clearance L2 is obtained from the pierce terminal 6 to the backup plate 8. Therefore, a pressure to connect the conductor 101 to the pierce terminal 6, which is smaller than in the case shown by the cross-sectional view of FIG. 11(*b*), is provided.

As described above, the clearance (distance) L1, L2 between the pierce terminal 6 and the backup plate 8 varies in accordance with the arc and the plane (straight line). Therefore, the shearing state and the malleability of the conductor 101 vary at different positions. At least at predetermined positions, an appropriate connection state can be obtained.

Owing to this, the connection structure using the backup plates 8 does not require precise adjustment of piercing-through positions and provides an advantage of significantly facilitating the connection work.

As shown in FIG. 11(*d*), which is a cross-sectional view taken along line IV-IV of FIG. 10(*b*), the width H of the pierce plate 63 of the pierce terminal 6 substantially matches the diameter d of the engageable hole 81 of the backup plate 8. Therefore, a side end surface 631 of the pierce plate 63 of the pierce terminal 6 contacts an inner circumferential surface 81*a* of the backup plate 8 with certainty. A frictional force is generated therebetween and so the engaging state of the pierce plate 63 of the pierce terminal 6 and the backup plate 8 is maintained. As a result, the electric connection between the pierce terminal 6 and the flat cable 100 can be maintained with certainty.

As described above, the upper case in which the cover 2, the LED chip 3, the resistor 4, the intermediate terminal 5 and the pierce terminals 6 are incorporated, and the lower case 9 engaged with the engageable convexed part 110, are fit to each other. As a result, the pierce terminals 6 and the conductor 101 can be connected to each other. Thus, the LED chip 3 and the resistor 4 can be connected to the conductors 101.

Now, the function and effects of the LED unit according to this embodiment will be described. The LED unit 1 includes the upper case 7 for holding the LED chip 3 and the resistor 4, the pierce terminals 6 for electrically connecting the LED chip 3 and the resistor 4 to the flat cable 100, the lower case 9 located oppositely to the upper case 7 with respect to the flat cable 100 and fit with the upper case 7 for holding and attaching the flat cable 100 between the lower case 7 and the upper case 7, and the intermediate terminal 5 for causing the upper case 7 to hold the LED chip 3 and the resistor 4 and connecting the LED chip 3 and the resistor 4 to the pierce terminals 6.

The intermediate terminal 5 includes the two pairs of convexed springs 51 (51*a*, 51*b*) and 52 (52*a*, 52*b*). One pair of convexed springs 51 (51*a*, 51*b*) are engaged with the insertion concaved parts 77 of the upper case 7. The LED chip 3 and the resistor 4 are pressed to the pierce terminals 6 by the convexed springs 51*b* and 52*b*.

Owing to this structure, the intermediate terminal 5 is electrically connected with the LED chip 3 and the resistor 4. As a result, the LED unit 1 can have a stable electric circuit of the pierce terminal 6A for LED→the LED chip 3→the intermediate terminal 5→the resistor 4→the pierce terminal 6B for resistor.

The pierce terminals 6 and the intermediate terminal 5, the positions of which are fixed with respect to the upper case 7, can hold and thus fix the LED chip 3 and the resistor 4 therebetween. Therefore, the intermediate terminal 5 acts as a tool for fixing the LED chip 3 and the resistor 4 with respect to the upper case 7 as well as a circuit component.

The convexed spring 51*b* of the intermediate terminal 5 and the contact plate 61 of the pierce terminal 6A for LED hold and fix the LED chip 3 therebetween, and the convexed spring 52*b* and the contact plate 61 of the pierce terminal 6B for resistor hold and fix the resistor 4 therebetween. Hence, the distance between the convexed spring 51*a* inserted into the insertion concaved part 77 and positionally fixed to the upper case 7 and the convexed spring 51*b* is widened, and as a result, an urging force acts therebetween. This urging force can maintain electric connection between the LED chip 3, the pierce terminal 6A for LED and the intermediate terminal 5.

Similarly, the distance between the convexed spring 52*a* inserted into the insertion concaved part 77 and positionally fixed to the upper case 7 and the convexed spring 52*b* is widened, and as a result, an urging force acts therebetween. This urging force can maintain electric connection between the resistor 4, the pierce terminal 6B for resistor and the intermediate terminal 5.

The urging force between the convexed springs 51 and the urging force between the convexed springs 52 are generated by the width direction parts 5*b* of the intermediate terminal 5 being extended in a longitudinal direction thereof (i.e., the width direction of the flat cable 100). As can be seen from this, unlike a positional change in the thickness direction of a plate-like member or the like, even a small positional changed in the longitudinal direction of the plate-like member causes a large urging force.

Accordingly, an urging force necessary for stable connection can be obtained by a small positional change in a small space, which allows the component to be smaller and also improves the reliability of the electric connection.

The LED chip 3 and the resistor 4 are held and fixed in the state of being urged by the convexed springs 51*b* and 52*b* of the intermediate terminal 5 and the contact plates 61 of the pierce terminal 6A for LED and the pierce terminal 6B for resistor, and are fixed in a suspended state in the upper case 7. Therefore, stable electric connection can be obtained and the reliability can be improved.

In more detail, the light emission of the light emitting section 31 of the LED chip 3 generates heat in the LED chip 3 and the resistor 4. The generated heat thermally expands the members around the LED chip 3 and the resistor 4. The coefficient of thermal expansion of the members varies in accordance with the material thereof, and the upper case 7 formed of a resin is more easily expanded than the intermediate terminal 5 or the pierce terminals 6 formed of a metal material.

Therefore, in the case where the LED chip 3 and the resistor 4 are positionally fixed to the upper case 7 directly, the positional relationship among the members is shifted, which may destabilize the connection.

However, the LED unit 1 according to the present invention uses the intermediate terminal 5. Even if the positional relationship among the members is shifted, the intermediate terminal 5 is deformed as necessary and thus maintains the positional relationship among the pierce terminals 6, the LED chip 3/the resistor 4, and the upper case 7. Hence, even if heat generation changes the sizes, stable electric connection can be provided and the reliability can be improved.

The LED chip 3 and the pierce terminal 6A for LED to which the LED chip 3 is pressed are located between one pair of convexed springs 51*a* and 51*b*, and the resistor 4 and the pierce terminal 6B for resistor to which the resistor 4 is pressed are located in one pair of convexed springs 52*a* and 52*b*. Owing to this structure, the direction of the urging forces generated between the pair of convexed springs 51*a* and 51*b* and between the pair of convexed springs 52*a* and 52*b*, i.e., the direction in which the width direction parts 5*b* of the intermediate terminal 5 extend, matches the direction in which the LED chip 3 and the resistor 4 are pressed to the pierce terminals 6.

Accordingly, the urging forces generated in the intermediate terminal 5 can act on the LED chip 3 and the resistor 4 efficiently, which allows the component to be smaller and also improves the reliability of the electric connection.

The conductors 101 having a tensile strength of 480 to 550 MPa and the pierce terminals 6 are electrically connected to each other. As compared to the case where, for example, the pierce plate 63 pierces through, and is connected to, the conventional pure copper conductor, this structure of the present invention has an advantage that even if an external force is applied, an increase of the contact resistance can be suppressed and stable electric connection can be guaranteed.

Since the upper limit of the tensile strength is set to 550 MPa and the pierce plates 63 are formed of a copper alloy having a higher strength than that of the conductors 101, the risk that the pierce plates 63 are broken when piercing through the conductors 101 is reduced and secure electric connection can be realized.

The flat cable 100, including two conductors 101 located with a predetermined distance provided therebetween in the width direction and the nonconductive laminate sheet 102 for integrally covering the two conductors 101 to provide a planar form, is provided with the engageable convexed part 110 engageable with the cable fitting part 91 of the lower case 9. Owing to this, the pierce plate 63 of the pierce terminal 6A for LED and the pierce plate 63 of the pierce terminal 6B for resistor can be connected with the two conductors 101 more securely.

In more detail, when each pierce plate 63 pierces through the conductor 101, the conductor 101 is attracted in the piercing direction, namely, toward the center of piercing of the pierce plate 63 as seen from the top.

However, if the two pierce plates 63 pierce through the conductors 101 at different timings, the connection parts may shift.

In this example, the engageable convexed part 110 obtained by bending the flat cable 100 in a convexed manner is fit with cable fitting part 91 of the lower case 9 and then the flat cable 100 is held and fixed between the upper case 7 and the lower case 9. Owing to this, even if the timing at which the pierce plate 63 of the pierce terminal 6A for LED pierces through the conductor 101 and the timing at which the pierce plate 63 of the pierce terminal 6B for resistor pierces through the conductor 101 are shifted from each other, the position of the engageable convexed part 110 with respect to the cable fitting part 91 is not changed because the engageable convexed part 110 is engaged with the cable fitting part 91.

Accordingly, a load can be prevented from being caused to the connection part of the pierce plates 63 and the conductor 101 by the shift in the timings at which the two pierce plates 63 pierce through the conductor 101. Hence, the difficulty caused when a plurality of pierce plates 63 pierce through the conductors 101 for connecting the upper case 7 and the lower case 9 can be solved, and the reliability of the connection of the pierce plates 63 and the conductors 101 can be further improved.

The engageable convexed part 110 engaged with the cable fitting part 91 is held between the side surfaces in the longitudinal direction and the top surface of the lower case 9, and the bottom surface of the upper case 7 and the end projections of the upper case 7. Therefore, even if an external force is applied to the LED unit 1 in the longitudinal direction, the connection part of the pierce plates 63 and the engageable convexed part 110 can be prevented from being supplied with a large external force because the flat cable 100 is positionally fixed to the upper case 7 and the lower case 9 by the engageable convexed part 110. Accordingly, the stable electric connection state of the pierce plates 63 and the conductors 101 can be guaranteed.

The engageable convexed part 110 is held between the upper case 7 and the lower case 9. Therefore, the reaction force caused by holding the engageable convexed part 110 further strengthens the engagement of the attaching concaved part 73 of the upper case 7 and the case stopping parts 93 of the lower case 9.

The pierce terminals 6 include the pierce plates 63 piercing through, and connected to, the conductors 101, and lower case 9 is provided with the backup plates 8 for preventing the pierce plates 63 piercing through the flat cable 100 from coming off. Owing to this, the pierce plates 63 piercing through the conductors 100 can be easily prevented from inadvertently coming off from the flat cable 100, and thus the electric connection between the flat cable 100 and the pierce terminals 6 is stabilized. Hence, the reliability of the connection of the LED unit 1 is improved.

The pierce plates 63 are formed to have a generally rectangular cross-section, and the backup plates 8 are formed to be generally circular with the inner circular engageable hole 81. The diameter d of the engageable hole 81 of each backup plate 8 is substantially matched to the length of the rectangular cross-section of each pierce plate 63 in the longitudinal direction, namely, the width H thereof. Owing to this structure, the backup plates 8 having the above-described shape prevent the pierce plates 63 having the generally rectangular cross-section from coming off, and also the axes of the center of the backup plates 8 and the axes of the pierce plates 6 can be easily aligned to each other and thus the freedom of directivity of assembly can be improved.

The inner circumferential edge of the engageable hole 81 of each backup plate 8 is in contact with both side edges of the corresponding pierce plate 63 with certainty. This prevents the pierce plates 63 from coming off with certainty. Hence, the work of connecting the conductors 101 of the flat cable 100 and the pierce terminals 6 can be facilitated, and the reliability of the connection structure of the flat cable 100 and the pierce terminals 6 can be further improved.

The backup plates 8 are separately formed from the lower case 9. Owing to this, the material, the hardness and the like of the backup plates 8 can be freely set without being influenced by the material or the like of the lower case 9. Therefore, the capability of the backup plates 8 of preventing the pierce plates 63 from coming off can be improved with certainty without increasing the production cost of the lower case 9 or the like. Hence, the reliability of the connection structure of the flat cable 100 and the pierce terminals 6 can be improved with certainty without increasing the production cost.

The intermediate terminal 5 includes two pairs of convexed springs 51 and 52 in correspondence with the number of elements to be located, namely, the LED chip 3 and the resistor 4. This allows the urging forces generated in the convexed springs 51 and 52 to act on the LED chip 3 and the resistor 4 with certainty. This further improves the reliability of the electric connection.

In another embodiment, the backup plates 8 may be integrally formed with the lower case 9. In this case, the strength of the lower case 9 needs to be increased by, for example, incorporating glass fibers or the like into the lower case 9. Among the assembling steps, the step of assembling the backup plates 8 is unnecessary. Thus, the number of steps can be reduced by one.

In the embodiment described so far, the method for connecting the LED chip 3 and the resistor 4 to the flat cable 100 includes the terminal assembling step, the intermediate terminal assembling step, the upper case non-temporary assembling step, the backup plate assembling step, the engageable convexed part forming step, the engaging step, and the case fitting step. Owing to this, the LED chip 3 and the resistor 4, etc. held by the upper case 7 can be easily connected to the flat cable 100.

Especially, after the pierce terminals 6 and the intermediate terminal 5 are temporarily assembled to the upper case 7, the LED chip 3 and the resistor 4 are assembled owing to this, the LED chip 3 and the resistor 4, etc. can be "held" and "connected" at the same time using the intermediate terminal 5. This improves the workability of assembly.

Accordingly, this embodiment can provide a method capable of easily connecting the LED chip 3 and the resistor 4 to the flat cable 100.

This embodiment is described with the assumption that the LED unit 1 is attached to the flat cable 100 located in a vehicle. For this reason, the resistor 4 for adjusting the supply voltage of 12 V to 3.7 V suitable to the LED chip 3 is provided. When the original supply voltage is 3.7 V, the resistor 4 is not necessary, and the intermediate terminal 5 only needs to have one pair of convexed springs 51. Thus, the structure is simplified. In this case also, substantially the same effects as those of the LED unit 1 in this embodiment can be provided.

The LED unit 1 in this embodiment has a structure in which the engageable convexed part 110 of the flat cable 100 is engaged with the cable fitting part 91 of the lower case 9 and then the upper case 7 and the lower case 9 are fit to each other. Alternatively, the LED unit 1 may have a structure in which the engageable convexed part 110 is engaged with the upper case 7 while the pierce plates 63 of the pierce terminals 6 attached to the upper case 7 is pierced through the flat cable 100 and then the upper case 7 and the lower case 9 are fit to each other.

The elements of the present invention and the elements in the above-described embodiment correspond as follows.

The LED component of the present invention corresponds to the LED chip 3 in this embodiment;

the first case of the present invention corresponds to the upper case 7 in this embodiment;

the connection terminal of the present invention corresponds to the pierce terminals 6 or the pierce terminal 6A for LED in this embodiment;

the second case of the present invention corresponds to the lower case 9 in this embodiment;

the connection structure of the present invention corresponds to the LED unit 1 in this embodiment;

the terminal member of the present invention corresponds to the intermediate terminal 5 in this embodiment;

the planar conductors of the present invention corresponds to the conductors 101 in this embodiment;

the covering member of the present invention corresponds to the nonconductive laminate sheet 102 in this embodiment;

the case engageable part of the present invention corresponds to the engageable convexed part 110 in this embodiment;

the piercing connection part of the present invention corresponds to the pierce plate 63 in this embodiment;

the coming-off prevention means of the present invention corresponds to the backup plates 8 in this embodiment; and the length in the longitudinal direction of the present invention corresponds to the width H in this embodiment.

The present invention is not limited to the above-described embodiment and can be carried out in various other embodiments.

The flat cable 100 may be covered with any nonconductive laminate sheet 102 which is formed of an insulating material to which the pierce terminals 6 can be connected easily, and is not specifically limited to the flat cable described in this embodiment. Specifically, the material of the nonconductive laminate sheet 102 is preferably a PET resin.

The terminal member may be H-shaped, square-shaped, U-shaped or the like as well as having the shape of two squares attached to each other as shown in the figures. The terminal member may have any shape which can "hold" and "connect" the LED chip 3 and the resistor 4 during the assembly.

The LED means the light emitting diode.

The pierce plates 63 are preferably tapered off toward the tips thereof.

What is claimed is:

1. A connection structure, comprising:

a first case for holding an LED component;

a connection terminal for electrically connecting the LED component to an electric cable;

a second case located opposite the first case with respect to the electric cable and fit with the first case for holding and attaching the electric cable between the second case and the first case; and a terminal member for causing the first case to hold the LED component and connecting the LED component to the connection terminal wherein the terminal member includes at least one pair of convexed springs, one of the convexed springs is engaged with the first case, the other convexed spring presses the LED component to the connection terminal, the electric cable is formed of a flat cable including a plurality of planar conductors located with a predetermined distance provided therebetween in a width direction and a covering member for integrally covering the plurality of planar conductors to provide a planar form, the connection terminal includes a piercing connection part piercing through, and connected to, the planar conductors, and the planar conductors are formed of phosphor bronze formed of tin (Sn), phosphorus (P), copper (Cu) and unavoidable impurities and having a tensile strength of 480 to 550 MPa, and the piercing connection part is formed of a high strength conductive member having a higher strength than that of the planar conductors and having conductivity.

2. The connection structure according to claim 1, wherein the LED component and the connection terminal to which the LED component is pressed are provided between the pair of convexed springs.

3. The connection structure according to claim 1 or 2, wherein the flat cable includes a case engageable part engageable with the first case or the second case.

4. The connection structure according to claim 1 or 2, wherein the second case is provided with a coming-off prevention means for preventing the piercing connection part piercing through the flat cable from coming off.

5. The connection structure according to claim 4, wherein the piercing connection part has a generally rectangular cross-section, the coming-off prevention means is generally circular with an inner circular hole, and the diameter of the hole of the coming-off prevention means substantially matches the length of the rectangular cross-section of the piercing connection part in a longitudinal direction.

6. The connection structure according to claim 4, wherein the coming-off prevention means is formed separately from the second case.

7. The connection structure according to claim 5, wherein the coming-off prevention means is formed separately from the second case.

* * * * *